US006241175B1

(12) United States Patent
Nichols

(10) Patent No.: US 6,241,175 B1
(45) Date of Patent: Jun. 5, 2001

(54) HOSE WINDING APPARATUS

(76) Inventor: Brad Nichols, P.O. Box 1451, Mayerthorpe, Alberta (CA), T0E 1N0

( * ) Notice: Subject to any disclaimer, the term of this patent is extended or adjusted under 35 U.S.C. 154(b) by 0 days.

(21) Appl. No.: 09/365,152

(22) Filed: Jul. 30, 1999

(51) Int. Cl.[7] ..... B65H 75/30

(52) U.S. Cl. ..... 242/395; 242/388.1; 242/404; 242/406; 242/407.1; 137/355.26; 137/355.27; D8/359

(58) Field of Search ..... 242/395, 395.1, 242/402, 404, 406, 407.1, 609, 118.3, 388.1, 388.5, 407; D8/359; 137/355.26, 355.27

(56) References Cited

U.S. PATENT DOCUMENTS

| | | | | |
|---|---|---|---|---|
| 1,543,121 | * | 6/1925 | Ravenscroft | 242/407.1 |
| 2,045,966 | | 6/1936 | Ruehmann . | |
| 2,839,257 | | 6/1958 | Chicane . | |
| 3,946,964 | | 3/1976 | Zinser . | |
| 4,198,010 | | 4/1980 | Knapp . | |
| 4,265,414 | | 5/1981 | Spralding . | |
| 4,592,519 | | 6/1986 | Peacock . | |
| 5,033,690 | | 7/1991 | McIver . | |
| 5,188,307 | | 2/1993 | Miller . | |
| 5,205,509 | | 4/1993 | Noggle . | |
| 5,505,404 | | 4/1996 | Dubreuil . | |
| 5,566,901 | | 10/1996 | Wilder . | |

FOREIGN PATENT DOCUMENTS

| | | |
|---|---|---|
| 2060759 | 8/1993 | (CA) . |
| 2115949 | 8/1995 | (CA) . |

OTHER PUBLICATIONS

2115949

* cited by examiner

*Primary Examiner*—John Q. Nguyen
(74) *Attorney, Agent, or Firm*—Faegre & Benson LLP

(57) ABSTRACT

A portable apparatus for use in winding a hose in which the apparatus comprises a support plate having at least one flat surface. There is further provided a peg which is mounted to the support plate and extends outwardly from the flat surface and a spindle which is removably securable to the support plate and extends outwardly from the flat surface. A rotation mechanism is provided to rotate the support plate about an axis, thereby, in use, rotating the hose to wind the hose about the peg and spindle and there is provided a support constructed so as to permit the apparatus to be releasably mounted to a vehicle or to be self-supporting.

19 Claims, 2 Drawing Sheets

HOSE WINDING APPARATUS

FIELD OF THE INVENTION

This invention relates to an apparatus for use in winding a hose, such as a fire hose or the like.

BACKGROUND OF THE INVENTION

One of the last steps in any operation involving a hose, be it a gardening hose or a fire hose is to wind the hose for storage for its next use. Particularly with fire hoses, what sounds like a simple operation is in fact an arduous task, often too much for one person. The weight and diameter of the hose make it both heavy and awkward for a single individual to wind effectively into a tight coil for storage. Further, if the hose is to be wound at a job site or otherwise at a location remote from where the hose is normally stored, it must be wound and then be easily moveable to a different location.

Although there have been numerous attempts in the past to address this problem and devise an acceptable solution, the devices conceived by these attempts suffer from numerous disadvantages such that the predominant method in use today is a manual one whereby one or more individuals manually wind the hose about a reel or support. For example, many of the devices disclosed in the prior art do not offer sufficient portability and ease of use, with the ability for one person to easily remove the wound hose from the device.

Examples of devices in the prior art which suffer from some or all of the disadvantages thus described include:

U.S. Pat. No. 5,566,901 of Wilder, issued Oct. 22, 1996

U.S. Pat. No. 5,505,404 of Dubreuil, issued Apr. 9, 1996;

U.S. Pat. No. 5,205,509 of Noggle, issued Apr. 27, 1993;

U.S. Pat. No. 5,188,307 of Miller, issued Feb. 23, 1993;

U.S. Pat. No. 5,033,690 of McIver, issued Jul. 23, 1991;

U.S. Pat. No. 4,592,519 of Peacock, issued Jun. 3, 1986;

U.S. Pat. No. 4,265,414 of Spralding, issued May 5, 1981;

U.S. Pat. No. 4,198,010 of Knapp, issued Apr. 15, 1980;

U.S. Pat. No. 3,946,964 of Zinser, issued Mar. 30, 1976;

U.S. Pat. No. 2,839,257 of Chicane, issued Jun. 17, 1958;

U.S. Pat. No. 2,045,966 of Ruehmann, issued Jun. 30, 1936;

Canadian Laid-Open Patent Application Serial No. 2,115,949, published Aug. 19, 1995; and Canadian Laid-Open Patent Application Serial No. 2,060,759, published Aug. 7, 1993.

SUMMARY OF THE INVENTION

It is thus an object of the invention to provide an apparatus for use in winding a hose, such as a fire hose or the like.

In one aspect of the invention, there is provided a portable apparatus for use in winding a hose in which the apparatus comprises a support plate having at least one flat surface. There is further provided a peg which is mounted to the support plate and extends outwardly from the flat surface and a spindle which is removably securable to the support plate and extends outwardly from the flat surface. The peg and spindle are tapered in opposite directions relative to the flat surface. A rotation means is provided to rotate the support plate about an axis, thereby, in use, rotating the hose to wind the hose about the peg and spindle and there is provided a support means constructed so as to permit the apparatus to be releasably mounted to a vehicle or to be self-supporting.

In another aspect of the invention, the spindle comprises a pin affixed to the flat surface of the support plate and a sleeve which is releasably attachable to the pin.

In another aspect of the invention, the peg comprises a tapered end at an end remote from the flat surface.

In another aspect of the invention, the spindle comprises a tapered end proximate to the flat surface.

In another aspect of the invention, the support means comprises a elongated member which has a first end attached to the bottom surface of a mounting means and which elongated member extends downwardly from the mounting means to a second end remote from the first end.

In another aspect of the invention, there is provided a bracket securable to a bumper of the vehicle. The bracket comprises a receiving means to releasably receive the second end of the elongated member.

In another aspect of the invention, the second end of the elongated member is constructed so as to be releasably received within an adapter receiving means and the adapter receiving means is releasably securable within a conventional trailer hitch on the vehicle.

There is thus provided a hose winding apparatus which is portable, effective and easy for one person to use to wind a fire hose or the like.

BRIEF DESCRIPTION OF THE DRAWINGS

These and other advantages of the invention will become apparent upon reading the following detailed description and upon referring to the drawings in which.

Figure 1:
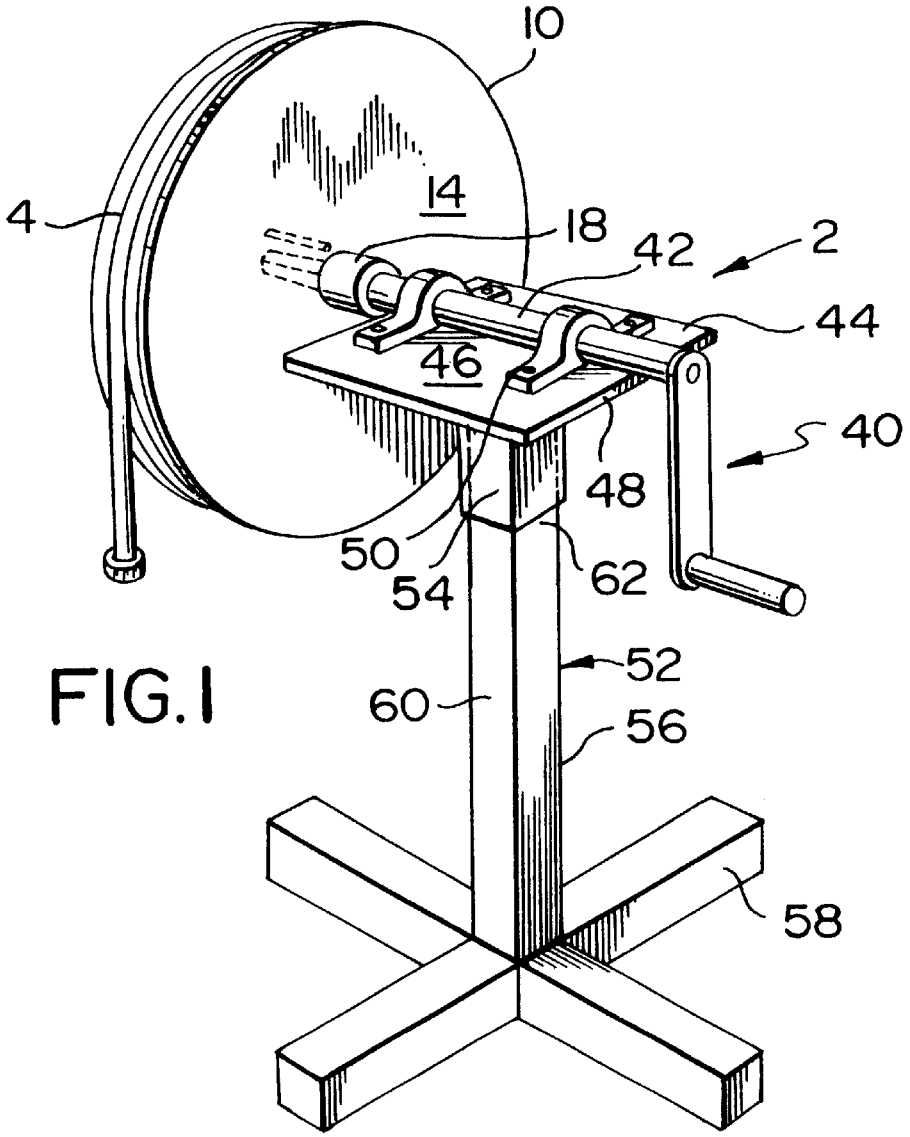
FIG. 1 is a perspective view of the hose winding apparatus in accordance with the present invention.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the following description, similar features in the drawings have been given similar reference numerals.

Turning to the drawings, FIG. 1 illustrates a portable apparatus 2 for use in winding a hose 4, such as a fire hose or the like, about an axis which is preferably horizontal but which may vary up to and including vertical. The apparatus 2 may be self supporting or may be constructed so as to mount to a vehicle 6 (shown in phantom in FIG. 3).

The apparatus 2 comprises a support plate 10, which is preferably a disc having a front surface 12 which is flat and a back surface 14, which can be flat or curved, without interfering with the operation of the apparatus 2. There may also be provided one or more apertures 16 provided in the plate 10, including an aperture 18 centred in the plate 10.

Figure 2:
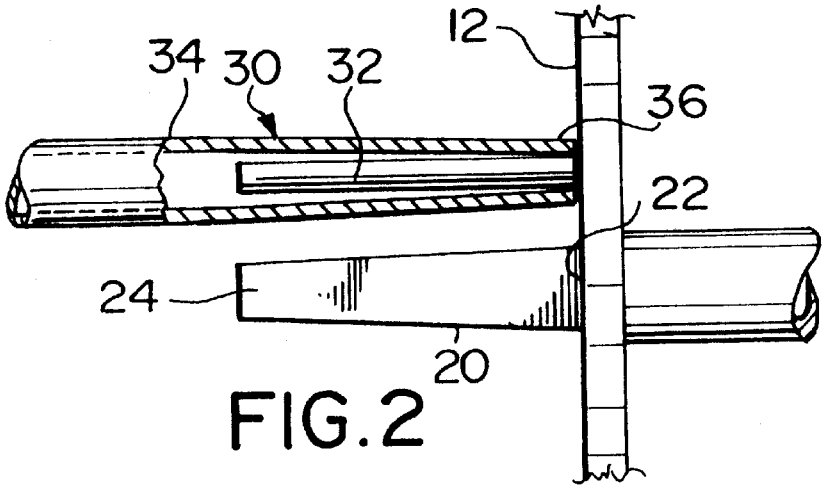
FIG. 2 is a side view, partially in section, of the apparatus of FIG. 1.

With reference to FIG. 2, there is also provided a peg 20 centred in the plate 10, which peg 20 may pass through the aperture 18, if that aperture is provided. Otherwise, one end 22 of the peg 20 is fixed to the front surface 12 of the plate 10 and extends outwardly therefrom, terminating at the second end 24. The second end 24 may be tapered so as to facilitate removal of a wound hose 4 in a manner to be more fully described below.

Offset from the centre peg 20 and also extending outwardly from the front surface 12 is a spindle 30 preferably constructed so as to be removable from the plate 10. The spindle 30 may thus be of a two-piece construction comprising a pin 32 welded or otherwise suitably fixed to the front surface 12 of the plate 10 and a sleeve 34 which is removably attachable to said pin 32. The sleeve 34 may held on to the pin 32 by means of a friction fit or may be mechanically attached by means of a simple locking arrangement. The end 36 of the sleeve 34 that is proximate to the front surface 12 when the sleeve 34 is in position on the pin 32 may be tapered so as to facilitate the removal of the sleeve 34 from the apparatus 2 once the hose winding operation has been completed. The removal of the sleeve 34 will be described in more detail below.

A rotation crank 40 is provided as the preferred means of rotating the apparatus 2 so as to wind the hose 4. It will be recognized by those skilled in the art that a suitable small motor or the like could be employed so as to motorize the rotation of the apparatus 2. Any such motor must be chosen so as to maintain the portability of the apparatus 2.

The rotation crank 40 shown in FIG. 1 comprises a shaft 42 which operatively mates with the plate 10, either by being fixed to the back surface 14, or by passing through the aperture 18. Thus, when the crank 40 is rotated, the plate 10 rotates. The shaft 42 is supported behind the plate 10 by means of a support platform 44 which is oriented normal to the plate 10 and which comprises a top surface 46 and a bottom surface 48. The shaft 42 is held on the top surface 46 of the platform 44 by at least one bracket 50.

Figure 3:
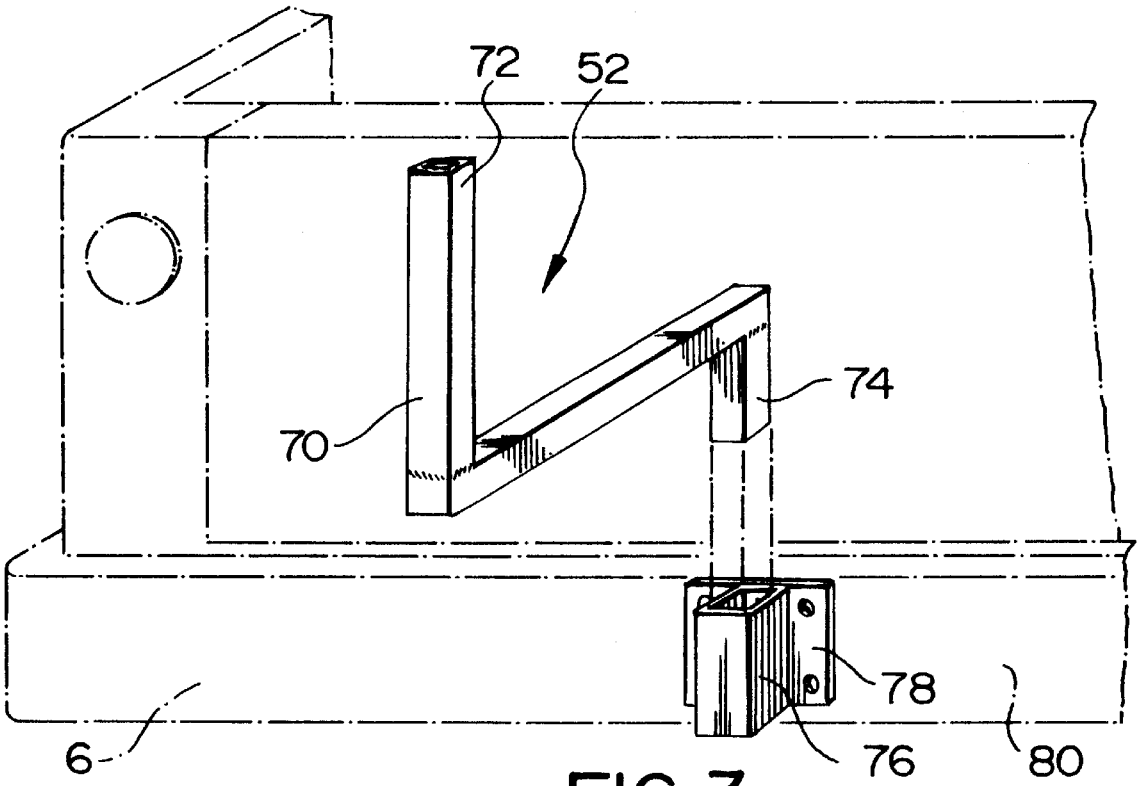
FIG. 3 is a partially exploded perspective view of an alternate embodiment of the present invention.
Figure 4:
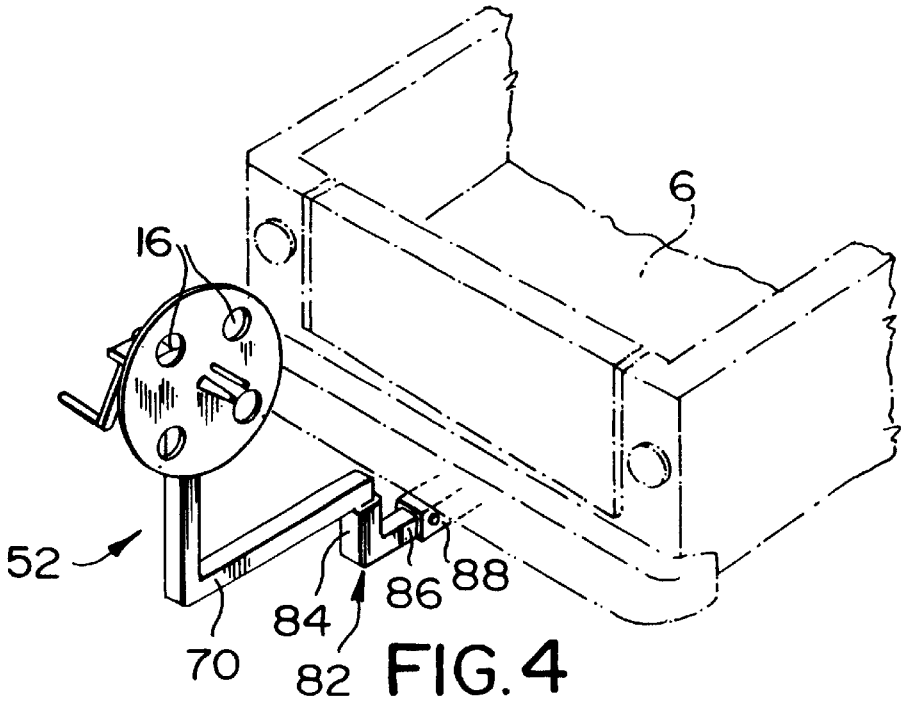
FIG. 4 is a partially exploded perspective view of a further alternate embodiment of the present invention.

The support means 52 for the apparatus 2 extends downwardly from the bottom surface 48 of the platform 44 and is held in place relative to the platform 44 by fitting over and securing to, in a friction fit, a protrusion 54 which extends downwardly from the bottom surface 48. With reference to FIGS. 1, 3 and 4, there is illustrated several embodiments of the support means 52. In FIG. 1, the support means 52 comprises a stand 56 so as to permit the apparatus 2 to be self-supporting. The stand 56 has a stable base 58 and an upstanding member 60 which may be hollow, at least at its top portion 62, and which is sized to permit a releasable engagement with the protrusion 54, which is hollow, by allowing the protrusion 54 to slide over the member 60.

In the illustrated embodiment shown in FIG. 3, the support means 52 is comprised of a elongated member 70, hollow at least at its first end or top portion 72 and sized to accommodate the protrusion 54, and extending downwardly to a second end or bottom portion 74. As shown, the member 70 may be bent so as reduce its overall height. The second end 74 is constructed so as to be received within a receiving portion 76 of a bracket 78 which is in turn mounted to a bumper 80 of the vehicle 6 (as shown in FIG. 3). In the embodiment illustrated in FIG. 4, the second end is received within an adapter receiving piece 82 which comprises a channel receiving portion 84 and a connecting member 86. The connecting member 86 is constructed so as to be releasably received within a conventional trailer hitch 88 on the vehicle 6.

In use, therefore, the apparatus 2 may be used in at least two different manners to create either a single end roll or a donut roll. With only the peg 20 in place on the front surface 12, a first end of the hose 4 is brought into engagement with the support plate 10. The crank 40 is turned so as to rotate the plate 10 one revolution to create a first wrap in the hose 4. The sleeve 34 is then placed in position on the pin 32 within the first wrap. The crank 40 is then rotated, thereby rotating the plate 10, to wind the hose 4 about the peg 20 and spindle 30 until the hose is wound as desired.

The sleeve 34 is then removed from the pin 32. The tapered end 36 facilitates removal of the sleeve 34 from the pin 32 by reducing the friction and interference between the sleeve 34 and the wound hose 4.

Once the sleeve 34 is removed, the wound hose 4 can be removed and the tapered end 24 of the peg 20 facilitates removal of the hose 4 by reducing the friction between the hose 4 and the peg 20. If the taper on the peg 20 is not present then there is a greater difficulty in removing the hose 4 due to an increased likelihood that the friction between the wound hose 4 and the peg 20 will be too great for one person to overcome, without moving the entire apparatus.

To create a single end roll, the first end of the hose 4 is placed in position between the peg 20 and the spindle 30. To create the donut roll, the centre of the hose 4 is placed in position directly on the peg 20, thus leaving both ends to the outside.

In either case, the apparatus 2 allows one person to wind a standard hose 4 by turning the crank 40 with one hand and guiding the hose 4 as it winds with the other hand. The removable sleeve 34 and the tapered end 24 if the peg 20 also allow one person to easily remove the hose 4, once it is wound, as desired. Any residual water in the hose 4 will be pressed out as the hose 4 is wound using the apparatus 2.

Thus, it is apparent that there has been provided in accordance with the invention a hose winding apparatus that fully satisfies the objects, aims and advantages set forth above. While the invention has been described in conjunction with illustrated embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

The embodiments of the invention in which an exclusive property or privilege is claimed are defined as follows:

1. A portable apparatus for use in winding a hose, said apparatus comprising:

a support plate having at least one flat surface;

a peg mounted to said support plate and extending substantially perpendicularly outwardly from said flat surface;

a spindle removably securable to said support plate adjacent said peg and extending substantially perpendicularly outwardly from said flat surface, wherein relative to said flat surface, and spindle comprises a taper in a direction opposite to a taper in said peg;

a rotation means to rotate said support plate about an axis thereby, in use, rotating said hose to wind said hose about said peg and spindle; and a support means constructed so as to permit said apparatus to be releasably mounted to a vehicle or to be self-supporting.

2. The apparatus of claim 1 wherein said support plate comprises a flat disc having an aperture centred therein.

3. The apparatus of claim 2 wherein said peg passes through said aperture.

4. The apparatus of claim 1 wherein said spindle comprises a pin affixed to said flat surface of said support plate and a sleeve releasably attachable to said pin.

5. The apparatus of claim 4 wherein said sleeve and pin are constructed so that said sleeve is attached to said pin by means of a friction fit.

6. The apparatus of claim 4 wherein said sleeve comprises a tapered end proximate to said flat surface.

7. The apparatus of claim 1 wherein said taper in said peg is at an end remote from said flat surface.

8. The apparatus of claim 1 wherein said taper in said spindle is at an end proximate to said flat surface.

9. The apparatus of claim 1 wherein said axis is horizontal.

10. The apparatus of claim 1 wherein said rotation means comprises a crank connected to a shaft attached to said support plate so as to rotate said support plate.

11. The apparatus of claim 1 further comprising a mounting means for supporting said rotation means on a top surface of said mounting means, whereby said support means is attached to a bottom surface of said mounting means.

12. The apparatus of claim 11 wherein said support means comprises a elongated member having a first end attached to said bottom surface, said elongated member extending downwardly from said mounting means to a second end remote from said first end.

13. The apparatus of claim 12 further comprising a bracket securable to a bumper of said vehicle, said bracket comprising a receiving means to releasably receive said second end of said elongated member.

14. The apparatus of claim 12 wherein said second end of said elongated member is constructed so as to be releasably received within an adapter receiving means, said adapter receiving means releasably securable within a conventional trailer hitch on said vehicle.

15. The apparatus of claim 1 wherein said support means comprises a portable stand, having a base and an elongated upstanding member.

16. A method of winding a hose using a portable apparatus according to claim 4, said method comprising the steps of:

bringing a first end of said hose into engagement with said support plate;

turning said rotation means so as to rotate said support plate one revolution to create a first wrap in said hose;

attaching said sleeve to said pin, within the first wrap;

continuing to rotate said rotation means thereby rotating said hose about said peg and spindle, until said hose is wound;

removing said sleeve; and removing said wound hose.

17. A method of winding a hose using a portable apparatus according to claim 1, said method comprising the steps of:

bringing a first end of said hose into engagement with said support plate;

turning said rotation means so as to rotate said support plate one revolution to create a first wrap in said hose;

inserting said removable spindle into said first wrap;

continuing to rotate said rotation means thereby rotating said hose about said peg and spindle, until said hose is wound;

removing said spindle; and removing said wound hose.

18. The method of claim 17 wherein said first end of said hose is brought into engagement with said support plate in a position between said peg and said spindle so as to create a single end roll.

19. The method of claim 17 wherein a centre of said hose is brought into engagement with said support plate in a position on said peg so as to create a donut roll wherein said first end and a second end of said hose are left exposed.

* * * * *